US008234839B2

(12) United States Patent
Miller et al.

(10) Patent No.: US 8,234,839 B2
(45) Date of Patent: Aug. 7, 2012

(54) APPARATUS AND METHOD FOR HANDLING PARTIALLY FORMED CONTAINERS

(75) Inventors: Russell P. Miller, Fowlerville, MI (US); Chadwick A. Wierenga, Linden, MI (US); Kenneth A. Poublon, Taylor, MI (US); Per I. Stykket, Horten (NO); William Baranek, South Lyon, MI (US)

(73) Assignee: Elopak Systems AG, Glattbrugg (CH)

( * ) Notice: Subject to any disclaimer, the term of this patent is extended or adjusted under 35 U.S.C. 154(b) by 690 days.

(21) Appl. No.: 11/919,805

(22) PCT Filed: May 2, 2006 (Under 37 CFR 1.47)

(86) PCT No.: PCT/GB2006/001590

§ 371 (c)(1), (2), (4) Date: Jul. 17, 2009

(87) PCT Pub. No.: WO2006/117539

PCT Pub. Date: Nov. 9, 2006

(65) Prior Publication Data

US 2009/0301599 A1 Dec. 10, 2009

Related U.S. Application Data

(60) Provisional application No. 60/676,886, filed on May 2, 2005, provisional application No. 60/676,903, filed on May 2, 2005, provisional application No. 60/676,915, filed on May 2, 2005, provisional application No. 60/676,916, filed on May 2, 2005.

(30) Foreign Application Priority Data

Mar. 15, 2006 (GB) ..... 0605136.1

(51) Int. Cl.
*B65B 61/00* (2006.01)

(52) U.S. Cl. ..... 53/410; 53/452; 53/561

(58) Field of Classification Search ..... 53/410, 53/420, 452, 456, 561, 563, 458, 253, 423, 53/331.5, 317, 450, 64; 493/241, 242, 305, 493/175; 414/568

See application file for complete search history.

(56) References Cited

U.S. PATENT DOCUMENTS 4,316,566 A * 2/1982 Arleth et al. ..... 226/2

(Continued)

*Primary Examiner* — Sameh H. Tawfik

(74) *Attorney, Agent, or Firm* — Warn Partners, P.C.

(57) ABSTRACT

A machine (2) for handling partially formed containers (6) comprising an indexing conveying device (8), a feeder (4) arranged to supply to the conveying device (8), per index, a plurality of partially formed containers (6), one or more stations (18, 20) comprising a plurality of devices arranged to perform substantially identical operations on a group of containers constituted by the plurality of partially formed containers (6), the indexing conveying device (8) being arranged to advance the group through the stations (18, 20), and a controlling device arranged to cause the feeder (4) to reduce to an integer the number of partially formed containers (6) supplied, per index, to the conveying device (8). The machine (2) is operated by the controlling device via a number of servomechanisms associated with each of the operations carried out by the machine. One of the servomechanisms is used for homing a moving mechanical part (72) of the machine (2), a servo motor (84) driving the moving mechanical part (72), the controlling device controlling the servo motor (84), and a mechanical stop (76) for stopping the moving mechanical part (72) at a home position, wherein the controlling device is arranged to monitor servo motor power draw and to recognize the home position as corresponding to a position of the servo motor (84) when the servo motor power draw reaches a predetermined value.

31 Claims, 7 Drawing Sheets

U.S. PATENT DOCUMENTS 4,594,123 A * 6/1986 Eder ..... 156/456
4,604,850 A * 8/1986 Reil ..... 53/423
4,790,123 A * 12/1988 Ljungstrom et al. ..... 53/458
4,876,842 A * 10/1989 Ausnit ..... 53/410
4,895,193 A * 1/1990 Rangwala et al. ..... 141/9
5,069,021 A * 12/1991 Reil et al. ..... 53/563
5,713,403 A * 2/1998 Clusserath et al. ..... 141/101
5,943,840 A * 8/1999 Nilsson et al. ..... 53/133.2
5,992,489 A * 11/1999 Busse ..... 156/443
6,276,113 B1 * 8/2001 Bernhard ..... 53/253
6,612,094 B1 * 9/2003 Bailey et al. ..... 53/234

* cited by examiner

APPARATUS AND METHOD FOR HANDLING PARTIALLY FORMED CONTAINERS

This application is a National Stage of International Application No. PCT/GB2006/001590, filed May 2, 2006 which claims priority to U.S. Provisional Patent Application No. 60/676,886 filed May 2, 2005; U.S. Provisional Patent Application No. 60/676,903 filed May 2, 2005; U.S. Provisional Patent Application No. 06/676,915 filed May 2, 2005; U.S. Provisional Patent Application No. 06/676,916 filed May 2, 2005 and GB 0605136.1 filed Mar. 15, 2006. The disclosures of the above applications are incorporated herein by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1 . Field of Invention

This invention relates to improvements in packaging apparatus and methods.

2 . Description of Related Art Including Information Disclosed Under 37 CFR 1.97 and 1.98

Not applicable.

BRIEF SUMMARY OF THE INVENTION

According to a first aspect of the present invention, there is provided apparatus for handling partially formed containers comprising an indexing conveying device, a feeder arranged to supply to said conveying device, per index, a plurality of partially formed containers, a station comprising a plurality of devices arranged to perform substantially identical operations on a group of containers constituted by said plurality of partially formed containers, said indexing conveying device being arranged to advance said group through said station, and a controlling device arranged to cause said feeder to reduce to an integer the number of partially formed containers supplied, per index, to said conveying device.

According to a second aspect of the present invention, there is provided a method of handling partially formed containers, comprising feeding to an indexing conveying device, per index, a plurality of partially formed containers, advancing a group constituted by said partially formed containers through a station comprising a plurality of devices arranged to perform substantially identical operations on said group, and controlling said feeding, to reduce to an integer the number of partially formed containers supplied, per index, to said conveying device.

Owing to these two aspects, it is possible to provide apparatus for handling a partially formed container that can continue to operate at a diminished capacity after one of the devices of the apparatus fails to operate properly, and do so without producing defective containers such as uncapped (i.e. without pour spout fitments), unfilled, or unsealed containers.

According to a third aspect of the present invention, there is provided apparatus for handling partially formed containers, comprising a conveying device including a plurality of receiving portions for receiving partially formed containers, a plurality of stations arranged to perform operations on said partially formed containers, at least one of said stations comprising a heating device, and a controlling device arranged to control said conveying device, said conveying device being arranged to advance said partially formed containers through said stations and, following receipt thereby from said controlling device of a command to cease operation to halt said receiving portions such that they are offset from said heating device.

According to a fourth aspect of the present invention, there is provided a method for handling partially formed containers, comprising receiving a plurality of partially formed containers in a plurality of respective receiving portions of a conveying device, advancing said conveying device through a plurality of stations, performing at said stations operations on said partially formed containers, said performing including heating with a heating device said partially formed containers at least one of said stations, and displacing said receiving portions such that they are offset from said heating device, following receipt of said conveying device of a command to cease operation.

Owing to these two aspects, it is possible to provide apparatus for protecting partially formed containers from heat damage when the operation of the apparatus is stalled. No partially formed container should suffer heat damage, as it would be offset from the heating device.

According to a fifth aspect of the present invention, there is provided apparatus for homing a moving mechanical part, comprising a servo motor for driving said moving mechanical part, a controlling device controlling said servo motor, and a mechanical stop for stopping said moving mechanical part at a home position, wherein said controlling device is arranged to monitor servo motor power draw and to recognise said home position as corresponding to a position of said servo motor when said servo motor power draw reaches a predetermined value.

According to a sixth aspect of the present invention, there is provided a method of homing a moving mechanical part, comprising controlling a servo motor, driving said mechanical part by said servo motor, stopping said moving mechanical part at a home position by a mechanical stop, monitoring servo motor power draw and recognising said home position as corresponding to a position of said servo motor when said servo motor power draw reaches a predetermined value.

Owing to these two aspects, it is possible to provide a more precise home position reading and obviate the need to mount and maintain a separate sensor.

According to a seventh aspect of the present invention, there is provided apparatus for filling a partially formed container comprising a filler nozzle, a filler pump arranged to receive a product from a product reservoir and supplying said product to said filler nozzle, and a controlling device arranged to control said filler pump according to a selected one of a plurality of electronic cam profiles.

According to an eighth aspect of the present invention, there is provided a method of filling a partially formed container comprising receiving product from a product reservoir at a filler pump and supplying said product to a filler nozzle and controlling said filler pump according to a selected one of a plurality of electronic cam profiles.

Owing to these two aspects, it is possible to provide apparatus that includes at least two electronic cam profiles that can adapt filler pump operation. For example, the electronic cam profiles are selectable to adapt filler pump operation readily to suit different product viscosities.

BRIEF DESCRIPTION OF THE SEVERAL VIEWS OF THE DRAWINGS

In order that the invention may be clearly and completely disclosed, reference will now be made, by way of example, to the accompanying drawings, in which.

DETAILED DESCRIPTION OF THE INVENTION

Figure 1:
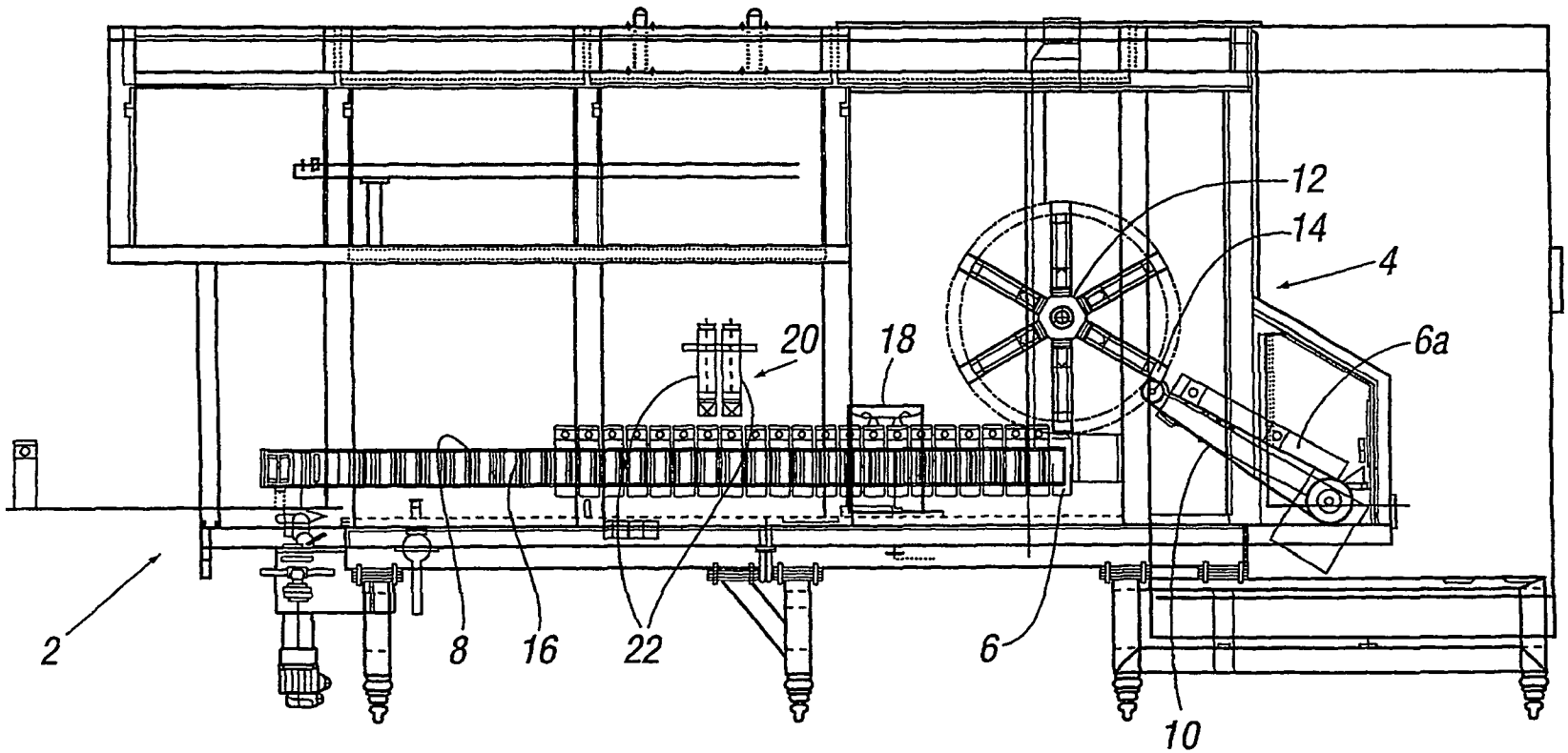
FIG. 1 is a side view of a container forming, filling and sealing machine.

Referring to FIG. 1, a machine 2 for at least container forming and filling comprises a container feeder 4 which feeds partially formed, open-topped containers 6 to a conveying device 8. The container feeder 4 includes a loader 10 supplying open container sleeves 6*a* to a rotating turret 12 having six radially extending mandrels 14. The turret 12 is caused to rotationally index received container sleeves 6*a* through container bottom forming stations which fold, close and seal the container bottoms which will be discussed in more detail hereinafter. A container stripper strips the partially formed containers 6 from the mandrels 14 with suction cups into a transfer area where a transfer pusher pushes the partially formed containers 6 into container receiving portions in the form of container pockets 16 of the conveying device 8.

The conveying device drive of the machine 2, which is drivingly connected to the conveying device 8, is commanded to index the partially formed containers 6 in a single-file serial arrangement through double-operation stations. Respective pairs of servomechanisms simultaneously perform identical operations on each partially formed container 6 of successive pairs of such containers in the single-file serial arrangement, as the conveying device 8 indexes a pair of partially formed containers 6 at a time, into each double-operation station.

The conveying device 8 is a double-indexing conveyor and the turret 12 is a single-indexing turret. The turret 12 operates at twice the speed of the conveying device 8. With each conveyor index, a pair of serially arranged partially formed containers 6 is positioned at each of the double-operation stations. With each conveyor indexing motion the conveying device 8 is moved a distance equal to the width of two container pockets 16. The controlling device indexes the container feeder 4 at 86 containers per minute and the conveying device at 43 containers per minute.

The first double-operation station that the partially formed containers 6 pass through is a top pre-breaking station 18 which includes a pair of top pre-breaking mechanisms for performing identical top pre-breaking operations on each of the pair of partially formed containers 6 at the pre-breaking station 18. The second double-operation station that the partially formed containers pass through is a filling station 20 which includes a pair of fillers 22 for performing identical filling operations on each of the pair of partially formed containers 6 at the filling station 20. The filling station 20 is discussed in more detail below with reference to FIGS. 6 to 8. The filling station 20 also includes a pair of container lifters disposed beneath the conveying device 8 and which serve to lift the partially formed containers 6 at the filling station 20 up to the fillers 22.

A controlling device operates the machine 2. The controlling device is connected to the container feeder 4 and is programmed to command the container feeder 4 to feed the partially-formed containers 6 to the conveying device 8. The controlling device is also programmed to command the conveying device drive, that is drivingly connected to the conveying device 8, to index the containers to the double-operation stations 18 and 20. The mechanisms of the double-operation stations 18 and 20 which perform identical operations include a pair of servomechanisms or servo axes that simultaneously perform the identical operations on each partially formed container 6 of successive pairs. The controlling device is programmed to index the conveying device 8 only once for every two partially formed containers 6 that the controlling device commands the container feeder 4 to feed onto the conveying device 8.

The controlling device is further programmed to detect down-line faults in either of the two servomechanisms of the pair of servomechanisms at each double operation-station 18 and 20, and, in response, to display the fault information in graphical format on a screen, and to automatically shut down machine operation. The controlling device is also programmed, in response to the detection of a fault in either of the two servomechanisms at either of the double-operation stations 18 or 20, to command machine operation in an over-ride mode.

In the over-ride mode, the controlling device shuts down machine operation and, when prompted by a machine operator (or automatically), commands the feeder 4 to operate without feeding partially formed containers 6 onto the conveying device 8 in positions that would otherwise be operated upon by whichever servomechanism of the double-operation station 18 or 20 is faulted. This allows the remaining servomechanism at the double-operation station to continue performing operations on the partially formed containers 6 and allows the machine 2 to continue to operate at half capacity without wasting containers. In other words, the over-ride mode makes use of a redundancy inherent in the double-operation configuration of these stations and allows continued operation despite the failure of any one of their dual servomechanisms. The pairs of servomechanisms may include a pair of cap applicators.

The controlling device is configured to be connected to each servomechanism of the pairs of servomechanisms disposed at the double operation stations 18 and 20 and is programmed to disable each servomechanism of the pairs of servomechanisms disposed at the double operation stations 18 and 20 that would otherwise be performing operations on empty positions along the conveying device 8 to save energy and reduce component wear.

The controlling device is further configured to be connected to the loader 10 and a turret drive of the feeder 4 where the turret drive is drivingly connected to the feeder turret 12 and is configured to rotate the turret about a horizontal turret axis. The controlling device is programmed to command the loader 10 of the feeder 4 to load the container sleeves 6*a* on the six radially-extending mandrels 14 of the feeder turret 12 positioned to receive container sleeves 6*a* from the loader 10, and is further programmed to command the turret 12 to rotationally index the received container sleeves 6*a* through a plurality of bottom forming stations.

The controlling device is further programmed, when detecting a fault in any servomechanism of the pairs of servomechanisms, following machine shut-down and either automatically or when prompted by a machine operator, to disable the bottom forming and handling devices from operating on unoccupied mandrels 14. The disabled forming and handling devices include a bottom breaker, the reciprocal motion of a bottom heater in and out of each container sleeve 6*a* as driven by a solenoid-controlled air cylinder, and bottom pressure applicators. While the motion of the bottom heater is disabled, the heater remains heated throughout over-ride operation.

The controlling device is also configured to be connected to the container stripper and is programmed to command the container stripper to engage each partially formed container 6 on a suction cup of the container stripper and to draw each partially formed container 6 downwards from each turret mandrel 14 to the container transfer area when each turret mandrel 14 reaches the container stripping station at a six o'clock position of the turret. When detecting a fault in any servomechanism of the pairs of servomechanisms at one of the double operation stations 18 or 20, the controlling device is programmed to disable the container stripper from operating on unoccupied mandrels 14.

The controlling device is also configured to be connected to the transfer pusher and is programmed to command the transfer pusher to push the partially formed, open-topped containers 6 from the transfer area into respective adjacent pockets 16 of the conveying device 8. When detecting a fault in any servomechanism of the pairs of servomechanisms at either of the double-operation stations 18 or 20, the controlling device is programmed to disable the transfer pusher from operating when no partially formed container 6 will be present in the transfer area to save energy and to reduce wear and tear on these components.

Figure 2:
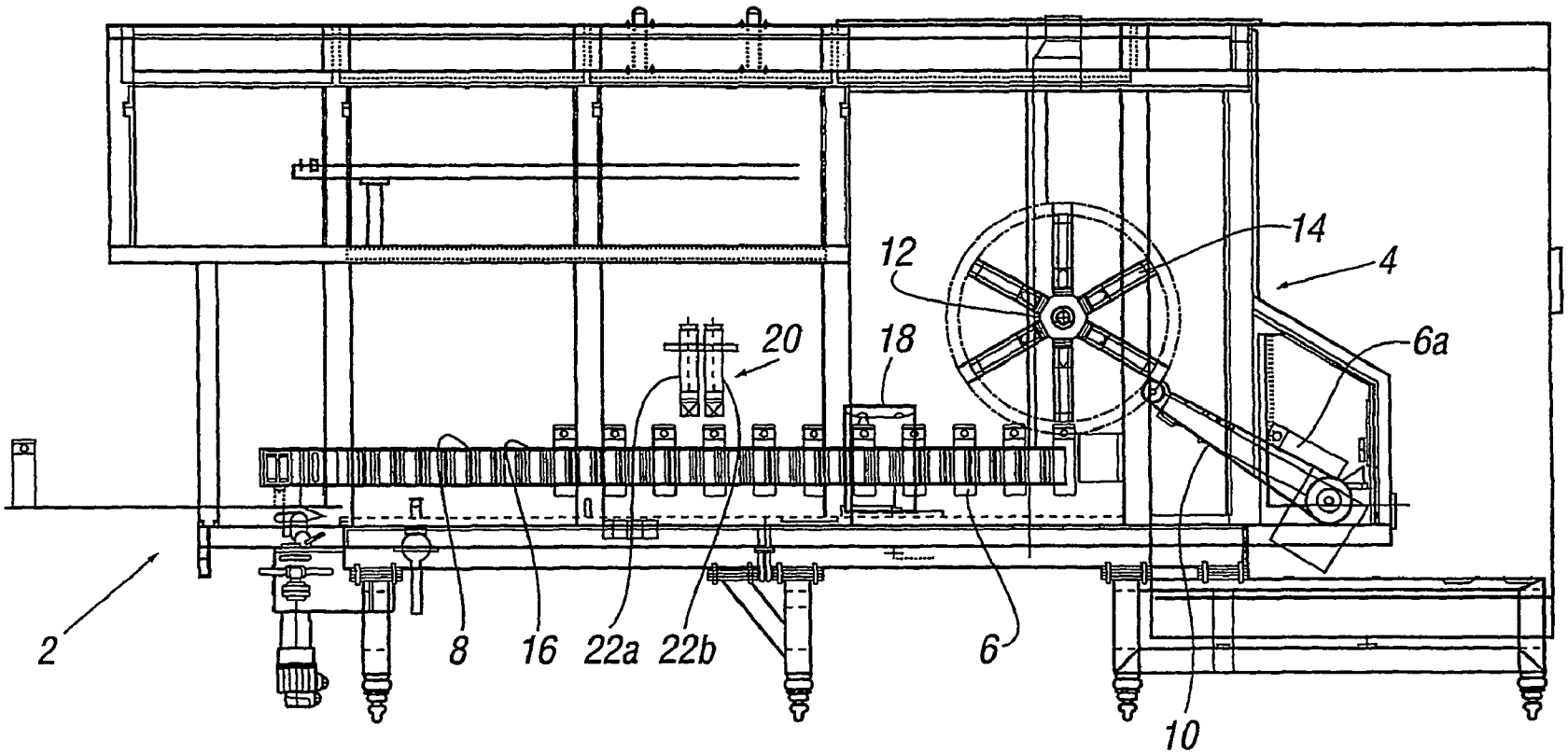
FIG. 2 is a view similar to FIG. 1 of the machine showing a different mode of operation.

FIG. 2 shows the machine 2 of FIG. 1 operating following detection of a fault in the filler 22*a*. The controlling device controls the feeder 4 to supply open container sleeves 6*a* only to alternate mandrels 14 of the turret 12. As a result of the reduced supply of container sleeves 6*a* to the turret 12, there is a reduction in the number of partially formed containers 6 supplied to the conveying device 8. The double-indexing conveying device 8 of FIG. 2 receives a single partially formed container 6 per index.

Figure 3:
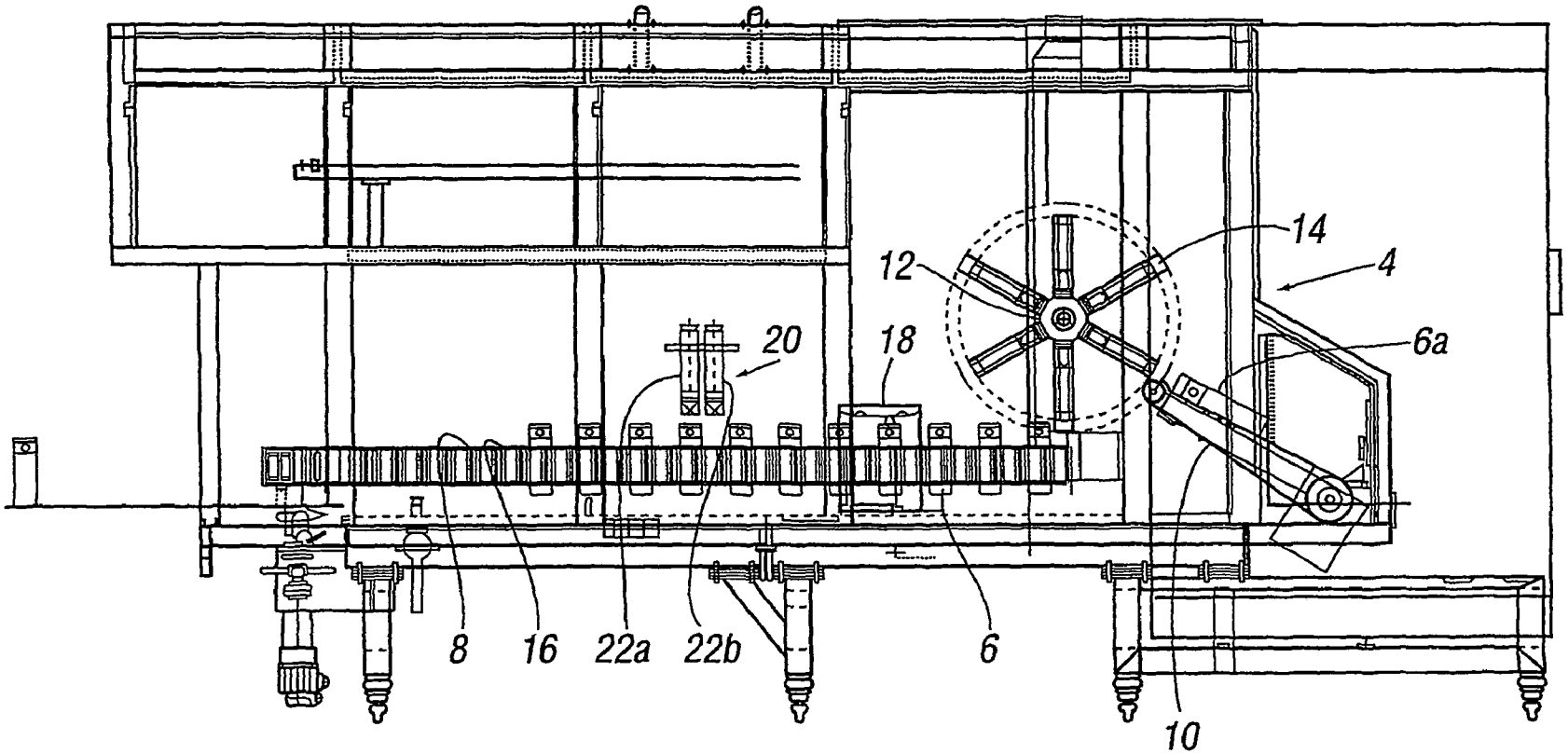
FIG. 3 is a view similar to FIGS. 1 and 2 of the machine showing a further mode of operation.

As can be seen in FIG. 2, when the index of the conveying device 8 reaches the filling station 20, a partially formed container 6 is present adjacent the filler 22*b*, but no partially formed container 6 is brought adjacent the faulty filler 22*a*. FIG. 3 shows the machine 2 of FIG. 1 operating following detection of a fault in the filler 22*b*.

Figure 4:
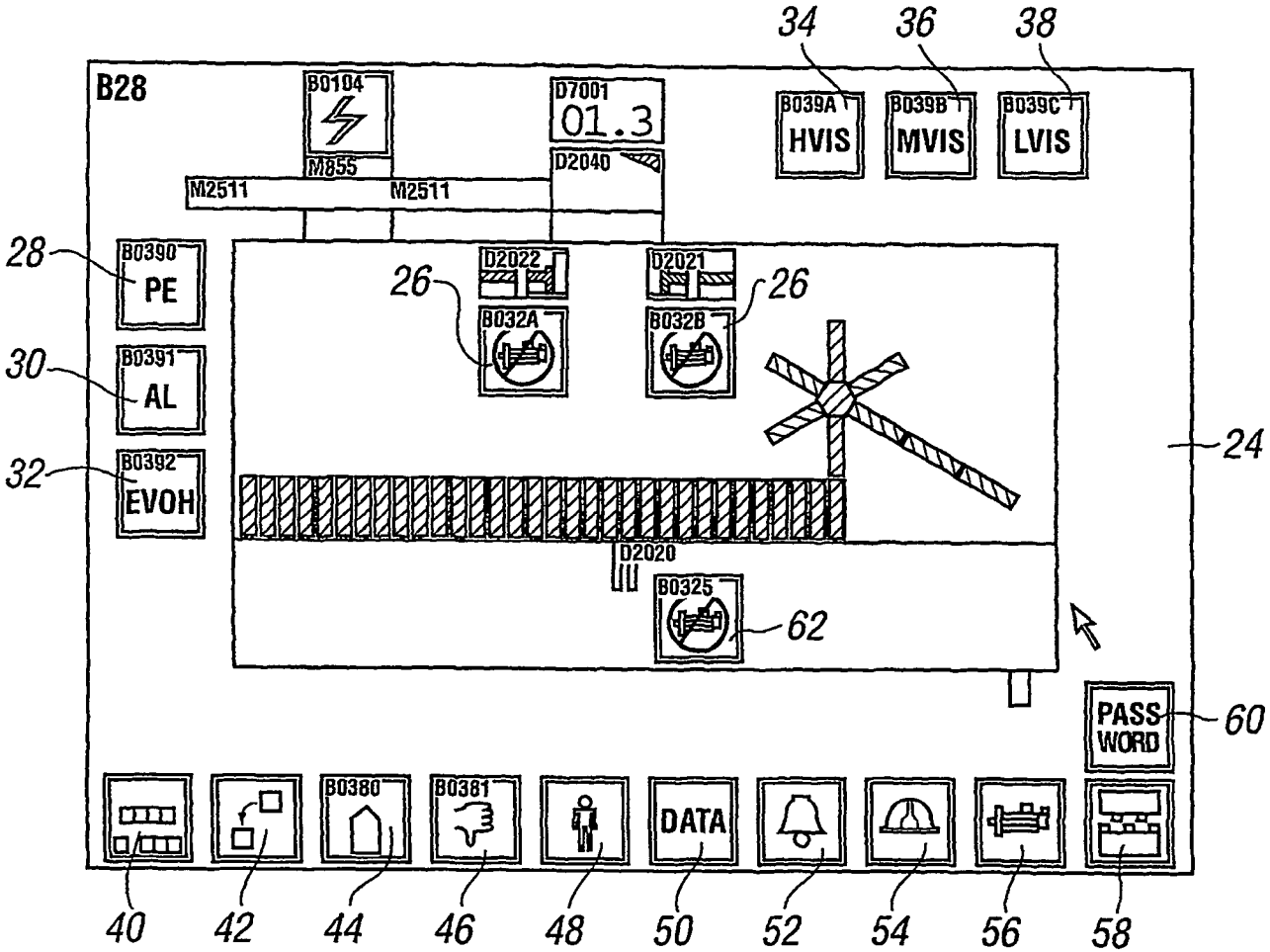
FIG. 4 is a screen shot of a control screen for the machine of FIGS. 1 to 3.

When a fault is detected in any of the servomechanisms of the servomechanism pairs disposed at either of the double operation stations 18 or 20, for example, the pair of top pre-breakers at the top pre-breaking station 18 or the pair of fillers 22 at the filler station 20, machine operation may be shut down in response. The fault information is displayed in graphical format on a human user-machine interface in the form of a screen 24, shown in FIG. 4, to an operator. The operator can decide whether to repair the machine or over-ride the fault. If the operator decides that he wants to over-ride the fault, he then presses a screen button 26 that causes the controlling device to command machine operation in the over-ride mode.

This generates a specific signal to the controlling device to control the feeder 4 to operate without feeding partially formed containers 6 onto the conveying device 8 in positions that would otherwise be operated upon by the servomechanism having the detected fault, allowing the remaining servomechanism at the same double-operation station to continue performing operations on partially formed containers 6. The machine 2 continues to operate at half capacity without producing any empty or partially-formed containers 6. Also disabled are each servomechanism of the pair of servomechanisms disposed at the other double operation station that would otherwise be performing operations on empty positions of the conveying device 8. The forming and handling devices and the container stripper are disabled from operating on unoccupied mandrels 14, and the transfer pusher is disabled during indexing periods when no partially formed container 6 will be present in the transfer area.

The machine 2 can also be configured to operate, when responding to a detection of a fault, automatically to reduce the number of partially formed containers 6 per index of the conveying device 8. In this case, the fault is the specific signal sent to the controlling device to control the feeder 4 to reduce the number of container sleeves 6*a* supplied to the mandrels 14.

The screen 24 allows the operator to control other aspects of the functioning of the machine 2. Buttons 28, 30 and 32 allow the operator to control aspects of the machine 2 according to the container type being supplied by the feeder 4. Button 28 indicates that a partially formed container 6 constructed from paperboard with a thin layer of polyethylene on either side is being supplied. Button 30 indicates that a partially formed container 6 that includes an aluminium barrier layer is being supplied and button 32 indicates a partially formed container 6 with an EVOH layer. The container type selector buttons 28, 30 and 32 change the temperature of the heaters of the bottom and top sealers.

Buttons 34, 36 and 38 are used to select the operation of the fillers 22 according to the viscosity of the product to be dispensed to the partially formed containers 6. Button 34 selects a filling function appropriate to a product of a high viscosity, such as yoghurt, button 36 selects medium viscosity and button 38 selects low viscosity. Buttons 34, 36 and 38 cannot be used when the machine 2 is actively filling.

Various function buttons are disposed along the bottom of the screen 24. Button 40 is a main menu button, button 42 is a back button, button 44 selects production mode, button 46 requests product to be supplied to the machine 2 and button 48 selects maintenance mode. Button 50 supplies current production data, for example the number of partially formed containers processed, button 52 is an alarm button, button 54 is a safety button, button 56 displays any servo motor faults and button 58 is a clutch page. Button 60 is a password button, and button 62 overrides the operation of the lifter servo motor. The lifter servo motor lifts the partially formed containers 6 prior to being filled at the filling station 20. For some sizes of containers and/or product, the lifting of the containers is overridden.

Each filler 22 of the filling station 20 comprises a filler nozzle, a filler pump arranged to receive a product from a product reservoir and supplying said product to said filler nozzle, and the controlling device is arranged to control said filler pump according to a selected one of a plurality of electronic cam profiles. The controlling device is programmed to operate a pair of piston-type filler pumps that are in fluid communication with a product reservoir on respective inlet sides of the pumps, and with filler nozzles on respective outlet sides of the pumps, causing the pumps to draw product from the product reservoir and to dispense product received from the product reservoir through the respective filler nozzles.

The conveying device 8 carries the partially formed, open topped containers 6 in a single-file serial arrangement through the filling station 20, pausing when each pair of partially formed containers 6 in the single-file serial arrangement is disposed at the filling station 20 in a position to receive product from the pair of filler nozzles. The controlling device also includes three operator-selectable filler cams having respective profiles that adapt the filler pump operation to the three different product viscosities. Consequently, the machine can be readily adapted to the dispensing of different products having different viscosities.

The filler cams are electronic cams programmed into a machine-readable program storage device. Filler cams selected for higher viscosity products such as yogurt are designed to operate the filler pump at correspondingly lower velocities to avoid breaking-down the viscosity of the product. Filler cams selected for higher viscosity products are also designed to increase dwell time between a pump pre-fill/pulling stroke that draws fluid from the product reservoir and a pump filling/pushing stroke that propels fluid through the nozzle. The increased dwell time helps to prevent more viscous products from dripping.

The controlling device also includes an operator interface that allows a machine operator to command the controlling device to change between the three different filler nozzle cam profiles of the filler nozzle cam profiles. The operator interface includes the graphical user interface displayed on the screen 24. As discussed, above, the operator interface includes three screen buttons labeled low viscosity, medium viscosity, and high viscosity that can be used to select and cause the controlling device to use one of three corresponding filler nozzle cam profiles.

The container lifters, which are controlled by a servo motor, follow a motion profile that is determined by an electronic cam, in the same way that the filler servo motor follows a motion profile that is determined by an electronic cam. The cam profile for the container lifters that lift up the partially formed containers prior to and during filling can be user selected, again according to the viscosity of the product being dispensed by the fillers 22.

Figure 5:
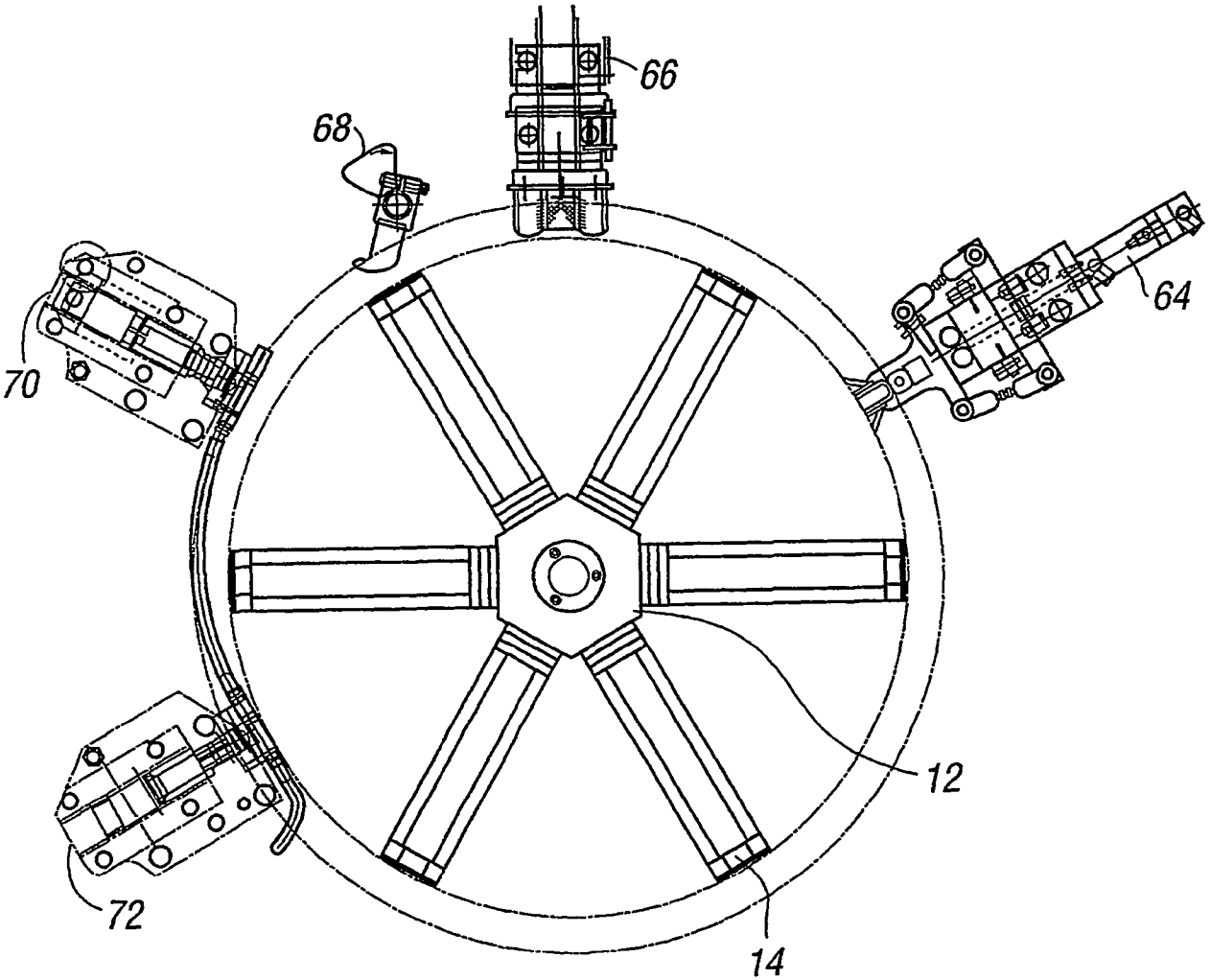
FIG. 5 is a side view of a turret and bottom folding, closing and sealing stations of the machine of FIG. 1, with mandrels of the turret shown in a mid-index position spaced between the stations.

FIG. 5 shows in more detail the turret 12 with the radially extending mandrels 14. The controlling device is connected to and is programmed to operate a turret drive that is drivingly connected to and rotationally indexes the turret 12 supported for rotation about a horizontal turret axis. The turret's six radially extending mandrels 14 are positioned to receive open container sleeves 6*a* from the feeder 10 and to carry the received sleeves 6*a* through a series of work stations including a bottom breaking station 64, a bottom end heating station 66, a bottom tucker 68, bottom end sealing and pressing stations 70 and 72, and a stripping station (not shown).

The container bottom end heating station 66 includes an electric resistance bottom end heating element that is supported on a reciprocating carrier and is continuously heated to 500° C. when the machine 2 is operating, except that the station 66 is unpowered during emergency stops. The heating element heats the partially folded paperboard bottom end flaps of the container sleeves 6*a* to the point where a heat-sealable substance coating of the paperboard flaps is softened for subsequent end closure and sealing. The heat sealable substance may be a thermoplastic substance such as low density polyethylene (LDPE), possibly with the interposition of an oxygen barrier layer, for example aluminium or ethylene vinyl alcohol (EVOH).

The controlling device pauses each turret mandrel 14 at each station so that respective operations can be performed on the partially-formed containers 6 at each station. When the turret pauses a mandrel 14 at the heating station 66, the reciprocating carrier advances the heating element to a position close to an axial outer end of the mandrel 14. At each of the two succeeding bottom end pressure stations 70 and 72, a bottom end pressure applicator advances radially inward to press the bottom end flaps together causing the softened heat-sealable substance is caused to form a seal across the container bottom end and to physically bind the bottom end flaps together into a single container bottom end panel.

The controlling device also operates the stripper that includes a suction cup mounted on a vertically reciprocating carrier. When this carrier is extended upward, the suction cup engages whatever partially formed container 6 the turret 12 has positioned at the stripping station, i.e., at a six o'clock position of the turret 12. This carrier is then retracted, drawing the partially formed container 6 downward from the respective mandrel 14 to a container transfer area. The controlling device is also programmed to operate a transfer pusher that pushes the partially formed containers 6 from the transfer area to the conveyor 8.

The controlling device is connected to and receives commands from a control screen. A machine stop command is issued to the controlling device by actuating, during machine operation, a stop button or a "feed" button displayed on the control screen. In response to such a machine stop command, the controlling device halts turret rotation but leaves the bottom end heating element of the station 66 in a heated state so that the element will be ready to quickly resume operations. To prevent container heat damage that would otherwise occur from being positioned for an extended period of time at the bottom end heating station in radial alignment with the bottom end heating element, the controlling device stops the turret at a mid-index position in which the mandrels are disposed between stations. The stopping of the turret 12 is an automatic process and the machine 2 enters idle mode within ten seconds of emptying.

The controlling device also stops the feeder 4 in response to a machine stop command so that containers will not be wasted as the machine continues to run during a subsequent stop period. The stop period is a period of approximately 10 seconds during which the controlling device allows the turret 12 and conveyor 8 to continue indexing to insure that no partially formed containers 6 are left in the machine 2.

The controlling device stops operations at each station in response to a machine stop command and after the last container passes. After receiving a machine stop command and after the last container has cleared the machine the controlling device clears a shift register and then, two seconds later, stops the conveyor 8.

The controlling device is programmed to re-align the turret from a mid-index stop by commanding the turret drive to move the turret from its half-index position to a normal index position synchronized with a machine virtual axis. A restart command is issued by actuating a restart button displayed on the control screen.

In practice, partially formed containers in the machine 2 can be protected from heat damage when machine operation is stalled by programming the controlling device to stop the turret at a mid-index position in response to a machine stop command and issuing a machine stop command by pressing either the stop button or the feed button on the control screen. This will also stop the feeder 4 but the turret 12 and conveyor 8 will continue indexing for a 10 seconds to insure that no partially formed containers 6 are left in the machine, and the bottom end heating element will remain in a heated state. After the last finished container passes out of the machine, the controlling device's shift register will clear and then, two seconds later, the conveyor 8 will stop. To restart the machine, a machine operator actuates the restart button displayed on the control screen which causes the controlling device to re-align the turret by commanding the turret drive to move the turret from its half-index position to a normal index position synchronized with a machine virtual axis.

Figure 6:
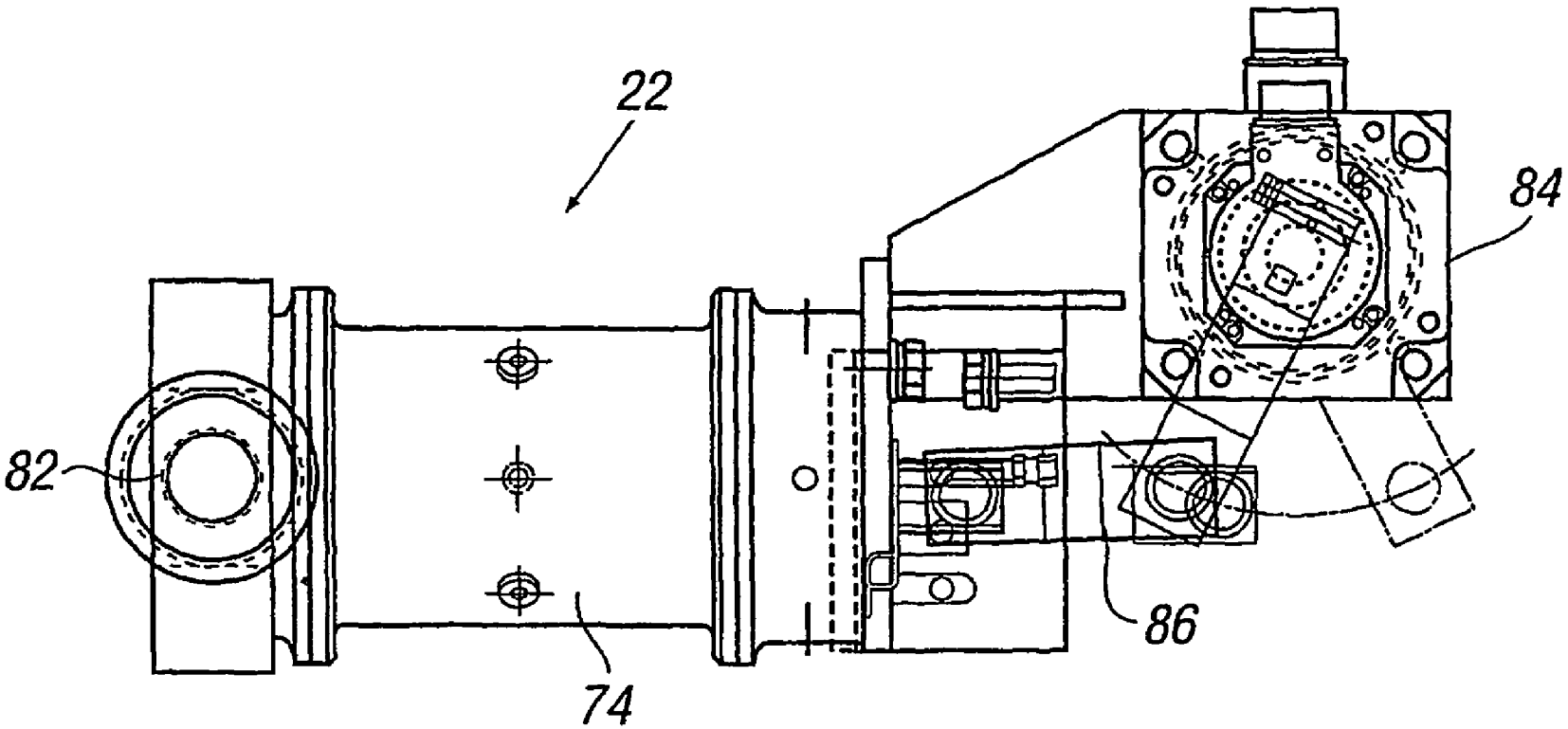
FIG. 6 is an underneath view of a filler pump and pump servo motor of FIG. 1.
Figure 7:
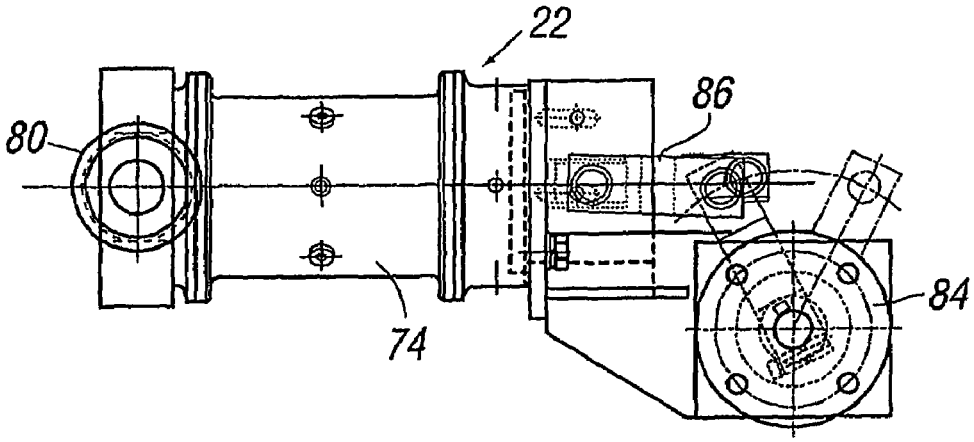
FIG. 7 is a top view of the filler pump and pump servo motor of FIG. 6.
Figure 8:
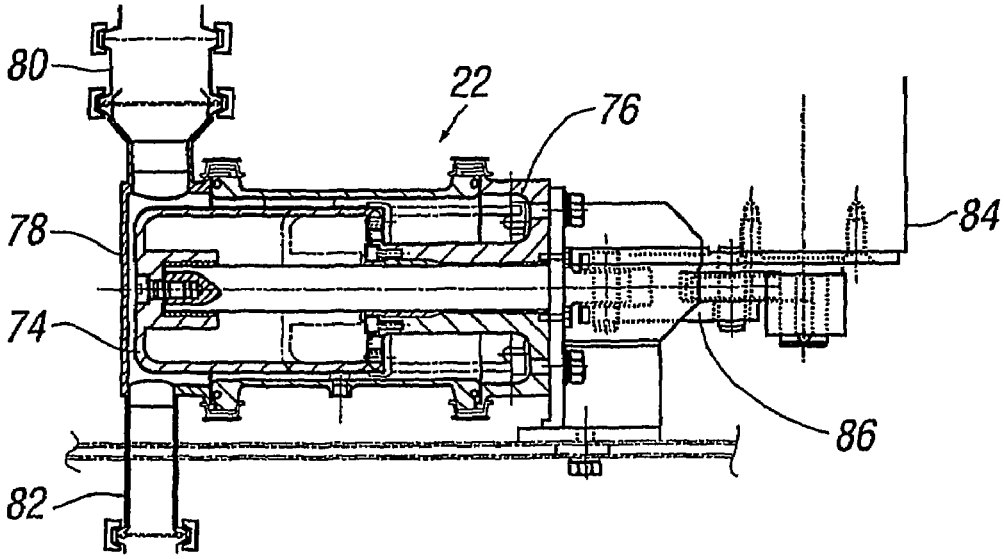
FIG. 8 is a cross-sectional view of the filler pump and pump servo motor of FIG. 6.

FIGS. 6, 7 and 8 show in more detail part of a filler 22 of the filing station 20 of the machine 2. A filler pump piston 72, of a pump 78, is supported for reciprocal motion in a cylinder 74 and a mechanical stop 76 is positioned in the cylinder 74 in a position to halt the piston 72 in a home position within the cylinder 74. The filler pump 78 is disposed at the filling station 20 and is in fluid communication with a product reservoir on an intake side 80 of the pump 78 and with filler nozzles on an output side 82 of the pump 78. The filler pump 78 is configured to draw product from the reservoir and to dispense product received from the product reservoir through the filler nozzle. Product is dispensed from the filler nozzle into a partially formed container 6 each time the conveying device 8 positions a partially formed container 6 in a position to receive product dispensed from the nozzle.

The filler pump piston 72 is reciprocally driven within the cylinder 74 by a rotary servo motor 84 through a servo linkage 86, the rotary reciprocal motion of the servo motor being commanded by the controlling device.

The mechanical stop 76 within the cylinder 74 (which can be formed as part of the cylinder) is used to determine a home position of the filler 22 when synchronisation of the various parts of the machine 2 is required. The normal working stroke of the piston 72 does not reach the stop 76, but when a homing programme is started, the servo motor 84 operates to extend the stroke of the piston 72 until the stop 76 is engaged by the cylinder 74. The controlling device is programmed to recognize the home position of the piston 72 as corresponding to the rotary position of the servo motor 84 when rotary servo motor power draw reaches a predetermined value.

In practice, the homing is accomplished by providing the mechanical stop 76 positioned to halt the motion of the piston 72 in a home position and recognizing the home position of the piston 72 as corresponding to the position of the servo motor 84 when power draw from the servo motor 84 reaches a predetermined value of 20% above a maximum power draw value (rated power value). The predetermined value, for greater accuracy, is preferable equal to 30% of the maximum motor power draw value. In other embodiments any suitable predetermined value may be used so long as it is high enough to prevent transitory power draw spikes from being mistaken for the homing of a part such as the piston 72.

SEQUENCE LISTING

Not applicable.

We claim:

1. Apparatus for handling partially formed containers comprising an indexing conveying device, a feeder arranged to supply to said conveying device, per index, a plurality of partially formed containers, a station comprising a plurality of devices arranged to perform substantially identical operations on a group of containers constituted by said plurality of partially formed containers, said indexing conveying device being arranged to advance said group through said station, and a controlling device arranged to cause said feeder to reduce to an integer the number of partially formed containers supplied, per index, to said conveying device.

2. Apparatus according to claim 1, wherein said conveying device is a double indexing conveyor, said station comprises a pair of mechanisms, and said controlling device is arranged to cause said feeder to supply a single partially formed container, per index, to said conveying device.

3. Apparatus according to claim 1, wherein said controlling device is arranged, upon receipt of a specific signal, to cause said feeder to reduce the number of partially formed containers supplied, as aforesaid.

4. Apparatus according to claim 3, and further comprising a fault detection device arranged to detect a fault in any of said plurality of devices and accordingly to communicate the existence of said fault as said specific signal to said controlling device.

5. Apparatus according to claim 3, and further comprising a user interface device arranged to generate said specific signal in response to a user input.

6. Apparatus according to claim 3, wherein said controlling device is further arranged, upon receipt of said specific signal, to disable a device, of the or each station, according to the content of the specific signal.

7. Apparatus according to claim 1, and further comprising one or more further stations each comprising a plurality of devices arranged to perform substantially identical operations on said group, said indexing conveying device being arranged to advance said group through said one or more further stations.

8. Apparatus according to claim 1, wherein the plurality of devices of said station or of one of the stations comprises a plurality of filling devices.

9. Apparatus according to claim 8, wherein said filling device comprises a filler nozzle, a filler pump for receiving a product from a product reservoir and supplying said product to said filler nozzle, and another controlling device arranged to control said filler pump according to a selected one of a plurality of electronic cam profiles.

10. Apparatus according to claim 1, wherein the plurality of devices of said station or of one of the stations comprises a plurality of pour spout fitment applying devices.

11. Apparatus according to claim 1, wherein said feeder comprises a feeder turret, a loader arranged to provide container sleeves around radially extending mandrels of said feeder turret, at least one container forming station through which said feeder turret is rotationally indexed to produce said partially formed containers from said container sleeves, and a stripper arranged to strip said partially formed containers from said mandrels.

12. Apparatus according to claim 11, wherein said loader is arranged to provide container sleeves around only alternate mandrels of said feeder turret when said feeder is to reduce the number of partially formed containers supplied, per index, to said conveying device.

13. Apparatus according to claim 12, wherein the arrangement is such that, when said loader provides container sleeves around only alternate mandrels of said turret, the or each container forming station is disabled from operating on unoccupied mandrels.

14. Apparatus according to claim 12, wherein the arrangement is such that, when said loader provides container sleeves around only alternate mandrels of said turret, said stripper is disabled from operating on unoccupied mandrels.

15. Apparatus according to claim 11, wherein one of the container forming stations comprises a heating device, said conveying device being further arranged to displace said mandrels such that they are halted in positions offset from said heating device when said controlling device issues a command to said conveying device to cease operation.

16. Apparatus according to claim 1, wherein one of the devices comprises a moving mechanical part, a servo motor for driving said moving mechanical part, a second controlling device for controlling said servo motor and a mechanical stop for stopping said moving mechanical part at a home position, wherein said second controlling device is arranged to monitor servo motor power draw and to recognise said home position as corresponding to a position of said servo motor when said servo motor power draw attains a predetermined value.

17. A method of handling partially formed containers, comprising feeding to an indexing conveying device, per index, a plurality of partially formed containers, advancing a group constituted by said partially formed containers through a station comprising a plurality of devices arranged to perform substantially identical operations on said group, and controlling said feeding, to reduce to an integer the number of partially formed containers supplied, per index, to said conveying device.

18. A method according to claim 17, wherein said controlling of said feeding reduces the number of partially formed containers supplied, per index, from two to one.

19. A method according to claim 17, and further comprising detecting a fault and correspondingly reducing to an integer the number of partially formed containers supplied per index.

20. A method according to claim 17, and further comprising, in response to a user input, reducing to an integer the number of partially formed containers supplied per index.

21. A method according to claim 17, and further comprising advancing said group through one or more further stations each comprising a plurality of devices which perform substantially identical operations on said group.

22. A method according to claim 17 and including filling of said group at said station or one of the stations.

23. A method according to claim 22, and further comprising controlling a filler pump according to a selected one of a plurality of electronic cam profiles.

24. A method according to claim 17 and including applying pour spout fitments to said group at said station or one of the stations.

25. A method according to claim 17, and further comprising disabling a device of the or each station, according to the content of a specific signal received by said controlling device.

26. A method according to claim 17, wherein said feeding comprises loading container sleeves onto radially extending mandrels of a feeder turret, indexing said feeder turret through at least one container-forming station to form said container sleeves into said partially formed containers, and stripping said partially formed containers from said mandrels.

27. A method according to claim 26, wherein said feeding includes loading said container sleeves onto only alternate mandrels.

28. A method according to claim 27, and further comprising disabling said container-forming stations from operating on unoccupied mandrels.

29. A method according to claim 27, and further comprising disabling said stripping in respect of unoccupied mandrels.

30. A method according to claim 26, wherein said group is heated at one of the container-forming stations, said method further comprising displacing said mandrels such that, upon said conveying device ceasing operation, they are offset from said one of said container-forming stations.

31. A method according to claim 17, and further comprising monitoring power draw of a servo motor driving a moving mechanical part, employing a mechanical stop to halt said moving mechanical part at a home position, and recognising said home position as corresponding to a position of said servo motor when said servo motor power draw reaches a predetermined value.

* * * * *